United States Patent [19]

Abciuk

[11] Patent Number: 4,569,175

[45] Date of Patent: Feb. 11, 1986

[54] FALSE CEILINGS

[76] Inventor: Pinhas Abciuk, 18 Hayozer St., Holon, Israel

[21] Appl. No.: 612,548

[22] Filed: May 21, 1984

[30] Foreign Application Priority Data

Oct. 24, 1983 [IL] Israel ..... 70044

[51] Int. Cl.[4] ..... E04B 5/55

[52] U.S. Cl. ..... 52/484; 52/311; 52/312; 52/463; 52/466; 52/718.1

[58] Field of Search ..... 52/484, 39, 489, 485, 52/482, 311, 312, 466, 463, 717, 718, 741

[56] References Cited

U.S. PATENT DOCUMENTS

| | | | |
|---|---|---|---|
| 1,659,988 | 2/1928 | Bloss et al. | 52/466 |
| 1,897,776 | 2/1933 | Venzie | 52/466 |
| 2,866,527 | 12/1958 | Schilling | 52/466 X |
| 3,212,224 | 10/1965 | Spangenberg | 52/484 X |
| 3,295,284 | 1/1967 | Tschiesche | 52/484 X |
| 3,387,872 | 6/1968 | Lovillo et al. | 52/463 X |
| 3,918,234 | 11/1975 | Weissman | 52/39 |
| 4,452,021 | 6/1984 | Anderson | 52/311 |

FOREIGN PATENT DOCUMENTS

| | | | |
|---|---|---|---|
| 670593 | 9/1963 | Canada | 52/484 |
| 1349297 | 12/1964 | France | 52/484 |

*Primary Examiner*—Alfred C. Perham

*Attorney, Agent, or Firm*—Fleit, Jacobson, Cohn & Price

[57] ABSTRACT

A false ceiling consists of a set which comprises two elements: a springy substantially U- or V-shaped clamp the free ends of its two tines being bent over towards the center of the clamp, two oppositely disposed notches being provided in the said tines; and an elongated U- or V-profiled beam or girder like, hollow rail the free edges of which are bent inwardly, towards the center of the rail.

2 Claims, 5 Drawing Figures

FALSE CEILINGS

BACKGROUND OF INVENTION

False ceilings intended for decorative purposes or to improve acoustics in a room of a building, or in order to place electrical wiring, air conditioning ducts or the like between the built ceiling of a room and the false ceiling, are well known. Conventionally the false ceilings are assembled from metal or plastics panels which are suspended from rail shaped — usually of inverted T-profile — carriers which, in turn, are fixedly attached to the built ceiling.

It has been found that the aesthetic aspect of the conventional false ceiling could be improved if the said T-shaped rails would no longer be exposed to view, as they are now.

The present invention provides a method and means for attaining the said purpose.

SHORT SUMMARY OF DISCLOSURE

According to the invention there is provided a set comprising two elements: a springy substantially U- or V-shaped clamp the free ends of its two tines being bent over towards the centre of the clamp, two oppositely disposed notches being provided in the said tines; and an elongated U- or V-profiled beam or girder like, hollow rail the free edges of which are bent inwardly, towards the centre of the rail.

The said clamp will preferably be made of metal, while the beam or girder like rail may be either metal or plastics.

The new method comprises the steps of clampingly attaching the clamp to the horizontal web of the inverted T carrier (which is fixed to the ceiling of the respective room) by engaging the web with the bent over free ends of the clamp and in a second step suspending the beam or girder like rail from the clamp by causing the bent over edges of the rail to engage in the oppositely disposed notches of the clamp.

SHORT DESCRIPTION OF DRAWINGS

The invention will now be described in detail with reference to the annexed drawings:

In the drawings:

FIG. 1 (*a–d*) shows schematically the profiles of the springy clamp.

FIG. 2 (I–VI), in a like manner, illustrates profiles of beam or girder like rails.

DESCRIPTION OF PREFERRED EMBODIMENT

Figure 1:
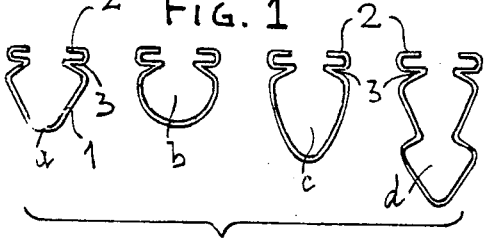

Turning first to FIG. 1, the different clamps are indicated by the numeral 1. All of them whether the V-shaped clamp a, the semi circularly profiled clamp b, the ovoidally profiled clamp c or the clamp d have their free ends bent inwardly at 2.

Further, all the clamps shown are provided with oppositely disposed, lateral notches 3.

The clamps are made of strips of springy material and in practice would be made of metal, but it is of course possible to make them of plastics, if strips of the necessary qualities can be bent or otherwise shaped to the desired form.

Figure 2:
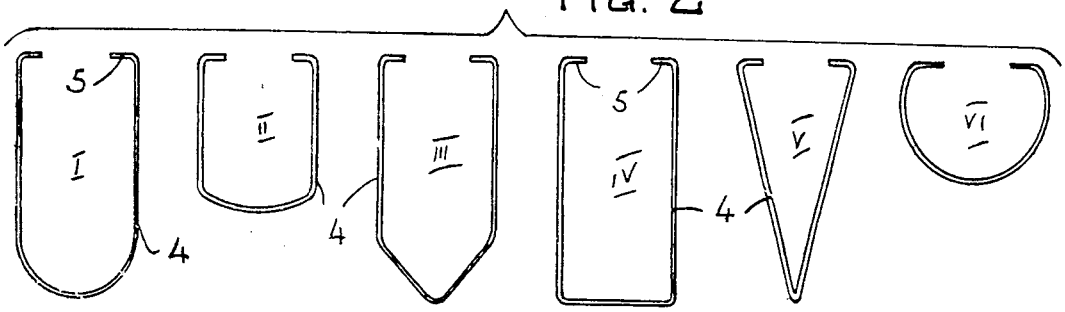

Possible profiles of the beam or girder like rail shown in FIG. 2 may be U-profiled, as seen in variants I and II or have a V-shaped bottom, as seen in III, or be of rectangular profile shown at IV, or of slender V-shape as V or of semi-circular profile, as VI. Obviously there do exist many more possibilities and the examples shown in FIG. 2 are not meant to restrict the invention to those shapes. All the profiles, indicated by numeral 4 have their free edges bent inwardly at 5.

Figure 3:
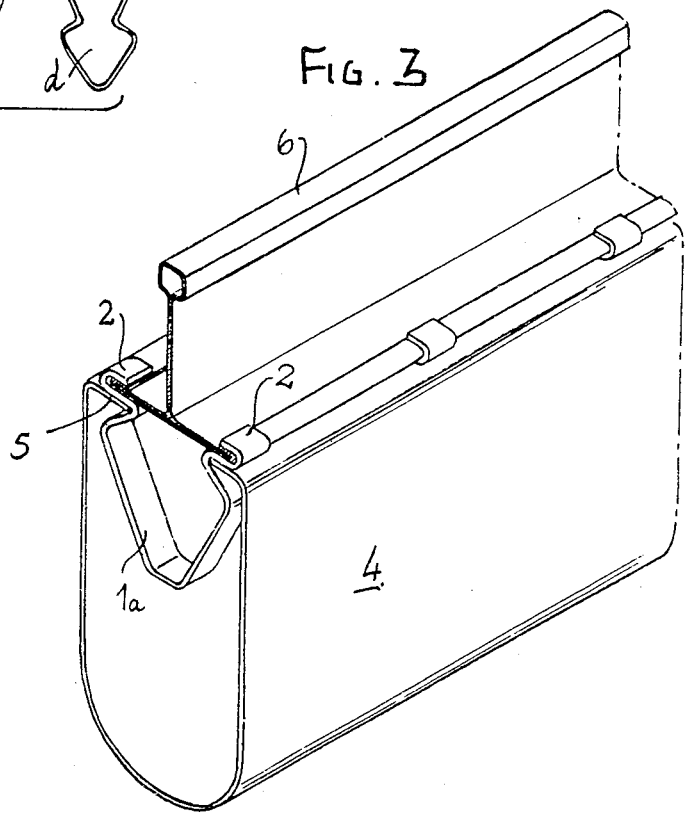
FIG. 3 is a perspective view of new set in position.

Turning now to FIG. 3 there is shown the conventional inverted T rail 6. Up till now the panels forming the false ceiling had been carried on the rails 6 with their flanged edges resting on the web of the T-rail, thus exposing to view the rail 6. In accordance with the present invention and with the use of the new set, the unsightly rails are no longer visible. As shown in FIG. 3 a clamp 1 (in the example shown 1*a*) is set on rail 6 by engaging the web thereof with the bent over portion 2 of the clamp. The clamp, being springy has its two tines spread apart and is made to snap close on the web of rail 6. A number of clamps 1 are so set on the whole length of the rail 6. Now the beam or girder like rail 5 is brought into position below tbe clamps 1 on the rail and is pushed upwardly to snap into position with its bent over edges 5 engaging in notches 3 of clamp 1.

The examples of FIG. 3 illustrates the use of clamp 1*a* and profile 1 of beam or girder like rail 4, but obviously the same effects can be reached with any of the profiles — both of clamps and of beam — or girder like rails — shown in FIGS. 1 and 2 or even similar ones which are not shown but possess the same features.

Figure 4:
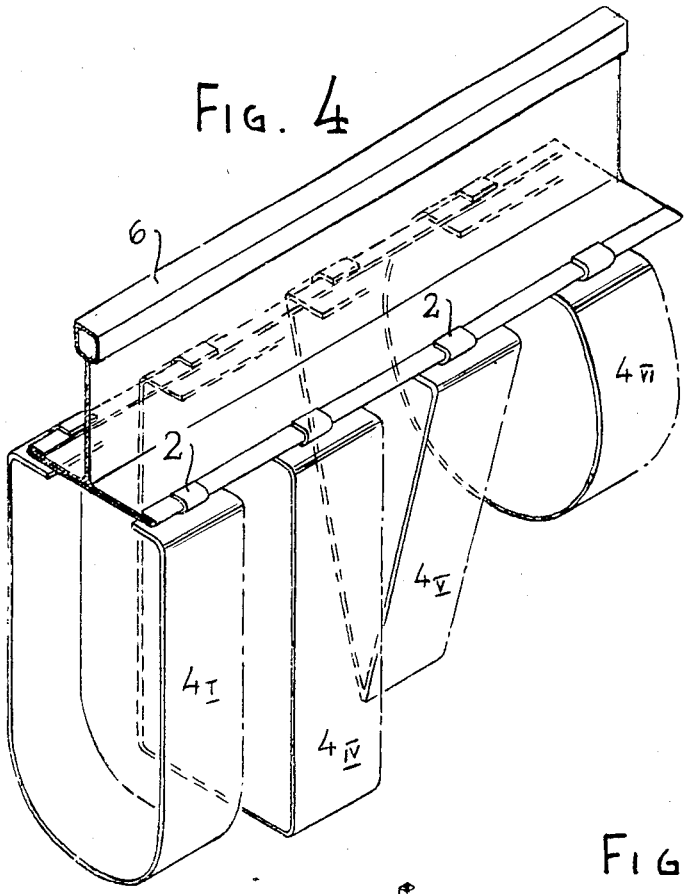
FIG. 4 illustrates the use of differently profiled clamps and girder like rails.

An example of such variety is shown in FIG. 4. Here in a row — starting from the left — are seen the profiles $4_I$, $4_{IV}$, $4_V$, $4_{VI}$. Of the respective clamps 1 only the bent over free ends 2 are seen in the drawing. Those skilled in the art would easily understand that the shown ends 2 symbolize any of clamps 1 shown in FIG. 1.

Figure 5:
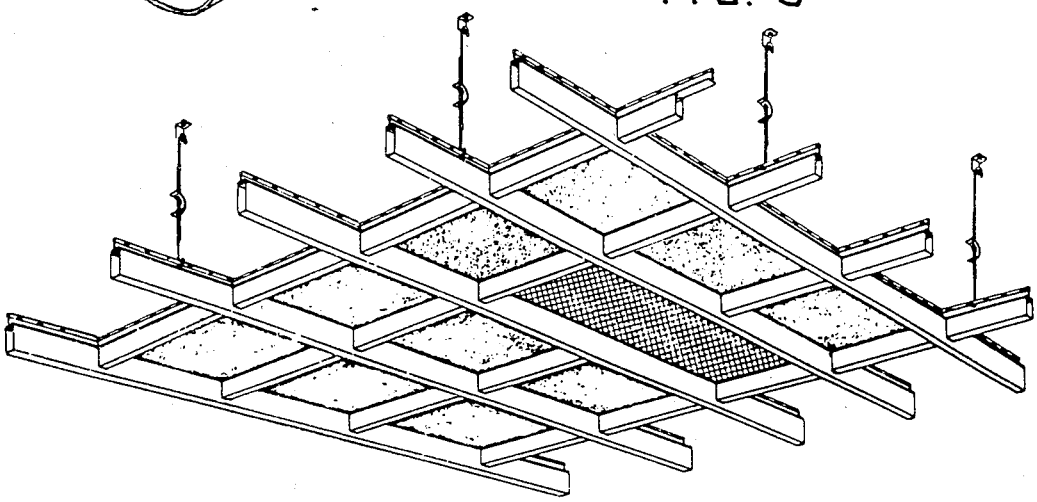
FIG. 5 is a fractional view of a false ceiling according to the invention.

It will be seen that by use of the new set the unsightly T-rail is hidden from view, the spectator sees a false ceiling composed of panels between which beams or girders extent, as shown in FIG. 5.

I claim:

1. A set for use with acoustic and/or decorative false ceilings, said ceilings comprise inverted T-profiled rails carrying panels of which the ceiling is assembled by supporting said panels by a horizontal web of said inverted T-profiled rails, said set comprising a springy substantially U- or V-shaped clamp, the free ends of its two tines being bent over towards the center of the clamp to snap close and to engage said web;

two oppositely disposed notches provided in said tines; and an elongated U- or V-profiled beam or girder like, hollow rail the free edges of which are bent inwardly, towards the center of the rail to snap into position with its bent inwardly free edges engaging said notches.

2. The method of assembling a false ceiling on a permanent ceiling, said false ceiling including inverted T-profiled panel carrying rails, said method comprising the steps of:

(a) affixing the imnverted T-profiled rails to the permanent ceiling;

(b) placing the panels in position to rest on a horizontal web of said inverted T-profiled rails;

(c) attaching a clamp to the horizontal web of the inverted T-profiled rails which are fixed to the permanent ceiling by engaging the web with bent over free ends of the clamp; and (d) suspending a beam or girder like rail from the clamp by causing bent over edges of the rail to engage in oppositely disposed notches of the clamp.

* * * * *